US011806766B2

(12) United States Patent
Meyer et al.

(10) Patent No.: US 11,806,766 B2
(45) Date of Patent: Nov. 7, 2023

(54) TREATMENT SYSTEM AND METHOD FOR TREATING WORKPIECES

(71) Applicant: ECOCLEAN GMBH, Filderstadt (DE)

(72) Inventors: Otfried Meyer, Nideggen-Schmidt (DE); Marko Flatten, Aachen (DE)

(73) Assignee: ECOCLEAN GMBH, Filderstadt (DE)

( * ) Notice: Subject to any disclaimer, the term of this patent is extended or adjusted under 35 U.S.C. 154(b) by 53 days.

(21) Appl. No.: 17/519,684

(22) Filed: Nov. 5, 2021

(65) Prior Publication Data

US 2022/0055079 A1 Feb. 24, 2022

Related U.S. Application Data

(63) Continuation of application No. PCT/EP2020/062756, filed on May 7, 2020.

(30) Foreign Application Priority Data

May 8, 2019 (DE) ..... 102019112045.4
Jun. 14, 2019 (DE) ..... 102019116297.1

(51) Int. Cl.
*B08B 7/04* (2006.01)
*B08B 3/02* (2006.01)
(Continued)

(52) U.S. Cl.
CPC ..... *B08B 7/04* (2013.01); *B08B 3/02* (2013.01); *B08B 3/048* (2013.01); *B08B 7/0014* (2013.01);
(Continued)

(58) Field of Classification Search
None
See application file for complete search history.

(56) References Cited

U.S. PATENT DOCUMENTS 4,984,351 A 1/1991 Matsuyama et al.
6,056,849 A 5/2000 Straemke
(Continued)

FOREIGN PATENT DOCUMENTS

DE 3921042 12/1989
DE 102006002644 1/2008
(Continued)

OTHER PUBLICATIONS

Google Patents translation of DE102008019825A1 retrieved from https://patents.google.com/patent/DE102008019825A1/en?oq=de102008019825 on Feb. 17, 2023 (Year: 2023).*
(Continued)

*Primary Examiner* — Eric W Golightly
(74) *Attorney, Agent, or Firm* — Sheridan Ross P.C.

(57) ABSTRACT

The invention relates to a treatment system for treating workpieces. Devices and methods of the disclosure are configured to perform at least one treatment operation on the workpiece, as well as at least one receiving unit for accommodating the workpiece on or in the treatment device. A transport device is provided that comprises at least one transport unit, with which the workpiece is transferable into a transfer position, from which the workpiece is transferable by means of the at least one receiving unit into a treatment position, as well as a control device for controlling the at least one treatment unit, the at least one receiving unit, and the at least one transport unit.

17 Claims, 7 Drawing Sheets

(51) Int. Cl.

| | |
|---|---|
| ***B08B 3/04*** | (2006.01) |
| ***B08B 7/00*** | (2006.01) |
| ***B08B 7/02*** | (2006.01) |
| ***B24C 1/08*** | (2006.01) |
| ***B24C 3/08*** | (2006.01) |

(52) U.S. Cl.
CPC ..... *B08B 7/028* (2013.01); *B24C 1/083* (2013.01); *B24C 3/083* (2013.01)

(56) References Cited

U.S. PATENT DOCUMENTS

| | | | | |
|---|---|---|---|---|
| 2013/0032980 | A1 | 2/2013 | David et al. | |
| 2015/0192921 | A1* | 7/2015 | Sugiyama | G05B 19/418 700/121 |
| 2016/0023251 | A1 | 1/2016 | Mitsue et al. | |

FOREIGN PATENT DOCUMENTS

| | | |
|---|---|---|
| DE | 102008019825 | 10/2009 |
| DE | 102010028489 | 11/2011 |
| DE | 202011103226 | 11/2011 |
| EP | 0856594 | 6/2001 |

OTHER PUBLICATIONS

Official Action for German Patent Application No. 102019116297.1, dated Nov. 23, 2020, 8 pages.
International Search Report and Written Opinion for International (PCT) Patent Application No. PCT/EP2020/062756, dated Aug. 20, 2020, 14 pages.
English Translation of the International Search Report for International (PCT) Patent Application No. PCT/EP2020/062756, dated Aug. 20, 2020, 2 pages.
English Translation of the International Preliminary Report on Patentability for International (PCT) Patent Application No. PCT/EP2020/062756, dated Nov. 18, 2021, 11 pages.

* cited by examiner

TREATMENT SYSTEM AND METHOD FOR TREATING WORKPIECES

CROSS-REFERENCE TO RELATED APPLICATIONS

This application is a continuation patent application of international application number PCT/EP2020/062756, filed on May 7, 2020, and claims the benefits of German application numbers DE 10 2019 112 045.4, filed on May 8, 2019 and DE 10 2019 116 297.1, filed on Jun. 14, 2019, which are incorporated herein by reference in their entirety and for all purposes.

FIELD OF THE INVENTION

The present invention relates to a treatment system for treating workpieces, comprising at least one treatment device that has at least one treatment unit, which is configured to perform at least one treatment operation on the workpiece, as well as at least one receiving unit for accommodating the workpiece on or in the treatment device, a transport device that comprises at least one transport unit, with which the workpiece is transferable into a transfer position, from which the workpiece is transferable by means of the at least one receiving unit into a treatment position, as well as a control device for controlling the at least one treatment unit, the at least one receiving unit, and the at least one transport unit.

The present invention also relates to a method for treating workpieces with a treatment system.

BACKGROUND OF THE INVENTION

US 2016/0023251 A1 describes a cleaning device for cleaning workpieces.

An object underlying the present invention is to provide a treatment system of the kind stated at the outset and a method, which makes it possible to efficiently perform treatment operations on workpieces.

SUMMARY OF THE INVENTION

In a first aspect of the invention, a treatment system for treating workpieces comprises at least one treatment device that has at least one treatment unit, which is configured to perform at least one treatment operation on the workpiece, as well as at least one receiving unit for accommodating the workpiece on or in the treatment device, a transport device that comprises at least one transport unit, with which the workpiece is transferable into a transfer position, from which the workpiece is transferable by means of the at least one receiving unit into a treatment position, as well as a control device for controlling the at least one treatment unit, the at least one receiving unit, and the at least one transport unit. The at least one treatment device comprises two or more receiving units for accommodating a respective workpiece for transferring independently of one another into the treatment position, wherein the control device controls the at least one treatment unit such that the workpieces are treated in a time-offset manner according to a treatment operation of the same kind.

In a second aspect of the invention, a method for treating workpieces with at least one treatment device that comprise at least one treatment unit is provided, the at least one treatment unit being configured to perform at least one treatment operation on the workpieces. In the method, two or more workpieces are transferable by means of a respective receiving unit of the treatment device independently of one another from a transfer position into a treatment position. The at least one treatment unit is controlled such that the workpieces are treated in a time-offset manner according to a treatment operation of the same kind.

BRIEF DESCRIPTION OF THE DRAWINGS

The foregoing summary and the following description may be better understood in conjunction with the drawing figures, of which.

DETAILED DESCRIPTION OF PREFERRED EMBODIMENTS OF THE INVENTION

Figure 1:
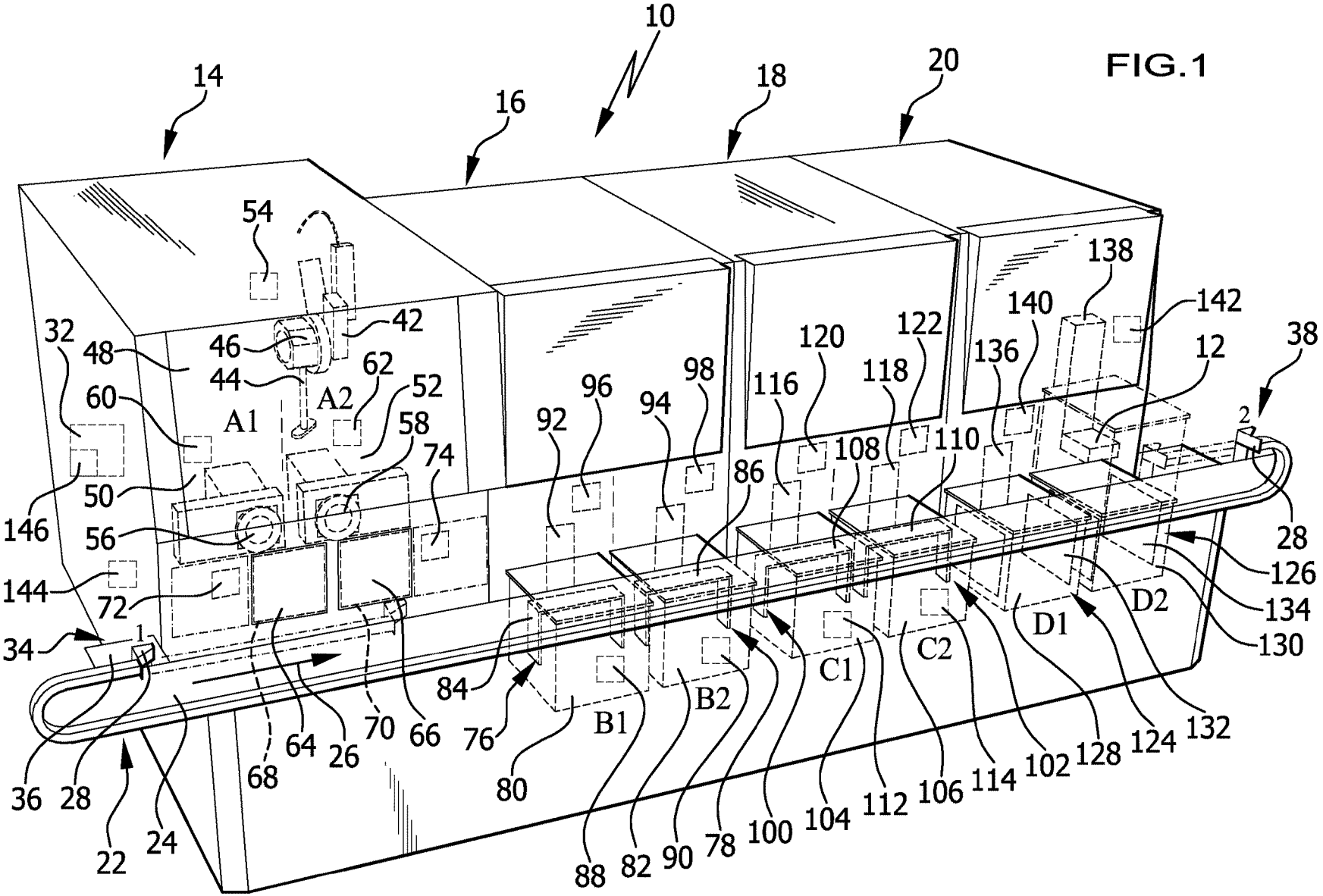
FIG. 1: shows a perspective schematic depiction of a treatment system in accordance with the invention for performing the method in accordance with the invention.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a treatment system for treating workpieces comprising at least one treatment device that has at least one treatment unit, which is configured to perform at least one treatment operation on the workpiece, as well as at least one receiving unit for accommodating the workpiece on or in the treatment device, a transport device that comprises at least one transport unit, with which the workpiece is transferable into a transfer position, from which the workpiece is transferable by means of the at least one receiving unit into a treatment position, as well as a control device for controlling the at least one treatment unit, the at least one receiving unit, and the at least one transport unit. The at least one treatment device comprises two or more receiving units for accommodating a respective workpiece for transferring independently of one another into the treatment position, wherein the control device controls the at least one treatment unit such that the workpieces are treated in a time-offset manner according to a treatment operation of the same kind.

In the treatment system in accordance with the invention, two or more receiving units for respective workpieces are provided in one treatment device. By means of the at least one treatment unit, the workpieces can be treated in a time-offset manner, wherein the same treatment operation is performed, in particular the same kind of treatment, though, for example, treatment parameters may differ from one another depending on the workpiece. The receiving units can be moved, in particular independently of one another, in order to transfer the workpieces from the transfer position into the treatment position and vice versa. In combination with the time offset in the treatment of the workpieces, it is possible, in particular, to reduce the total time required for setting up and changing the workpieces.

The present invention is suited, in particular, for surface-treating workpieces, in particular for cleaning and/or deburring workpieces. Within the meaning of the present invention, in particular, deburring can be considered to be cleaning.

In a preferred embodiment of the treatment system, it is possible, in particular, that a workpiece is treatable by means of the at least one treatment unit while at least one workpiece is transferable by means of the receiving unit associated therewith from the treatment position into the transfer position or vice versa. Dead times for the exchange of a workpiece can be used meaningfully with the at least one treatment device by a further workpiece being treated by means of the at least one treatment unit.

It is understood that the control device of the treatment system can control all processes. The control device is or comprises, e.g., a master computer for controlling the at least one treatment device and the transport device. Here, the control device can be configured and programmed such that the time required for exchanging workpieces and/or for treating workpieces can be minimized and carried out efficiently.

Provision may be made that no two or more workpieces are treatable at the same time by means of the at least one treatment unit.

In a preferred embodiment of the treatment system, provision may be made that the treatment device comprises two or more functionally equivalent and, in particular, identically configured treatment units, wherein a treatment unit is associated with a respective receiving unit. A respective workpiece can be transferred by a respective receiving unit into the treatment position and be treated by the respective treatment unit. Different workpieces are treated, time offset in relation to one another, by means of different treatment units of the treatment device. In a corresponding manner, the exchange of the workpiece may take place in a time-offset manner.

The number of treatment units is favorably identical to the number of receiving units for the workpieces.

In a preferred embodiment of the treatment system, provision may be made that the treatment device comprises or forms a receiving space and an adjusting unit for the at least one treatment unit, which is movable by means of the adjusting unit from a first spatial region in which a receiving unit is arranged into at least one further spatial region in which a further receiving unit is arranged, for treating a respective workpiece on the receiving unit according to the treatment operation. In the case of a treatment system of that kind, in particular, only one treatment unit can be provided within preferably only one treatment space. By means of the adjusting unit, the treatment unit can be brought to the first workpiece in order to treat same. During the treatment, for example, a workpiece can be exchanged at a different receiving unit. After treating the first workpiece, the treatment unit can be brought by means of the adjusting unit to the other workpiece in order to treat same. The previously treated first workpiece can be transferred into the transfer position and be removed from the at least one transport unit and be replaced by a different workpiece.

In the case of the last-mentioned advantageous embodiment, provision may advantageously be made that the exchange of workpieces is carried out, as mentioned above, during the treatment of a respective other workpiece at the at least one treatment device.

Provision may be made that exactly as many spatial regions are present as there are workpieces.

The spatial regions can be positioned without separation from one another and, for example, laterally next to one another. The treatment unit may be movable in the receiving space by means of the adjusting unit.

The at least one treatment unit is favorably displaceable by means of the adjusting unit in the receiving space along a direction that is aligned in parallel to a transport path of the transport device, along which the at least one transport unit is movable and, in particular, displaceable.

Alternatively or in addition, provision may be made that the receiving units, in particular the spatial regions, are positioned laterally next to one another along the transport direction.

In a preferred embodiment of the treatment system, provision may be made that the at least one treatment unit comprises a receiving space for accommodating the receiving units, in which the at least one treatment unit is arranged, as well as two or more cover elements that are associated with a respective receiving unit, wherein a respective cover element unblocks an opening of the receiving space when the receiving unit transfers the workpiece from the transfer position into the treatment position, and closes the respective opening when the workpiece is treated in the treatment position by means of the at least one treatment unit. The receiving space is protected from the ingress of dirt from the outside by means of the cover elements, which can selectively be opened for the exchange of the respective workpiece and otherwise remain closed. In addition, it can be prevented that, e.g., a medium used in treatment, for example a cleaning medium, is able to leak out of the receiving space.

The cover elements are configured, e.g., as displaceable or foldable plate-shaped cover elements.

For transferring the workpiece from the transfer position into the treatment position, the receiving units are favorably movable transversely and, in particular, perpendicularly to a transport direction, along which transport direction the at least one transport unit is movable and, in particular, displaceable, along a transport path of the transport device. Here, the transport path may be, in particular, of rectilinear configuration and define the transport direction.

Provision may be made that the receiving unit is arranged in the receiving space so as to be immovable in parallel to the transport direction. For example, the treatment unit may be movable, as explained above, by means of the adjusting unit in parallel to the transport direction.

It is advantageous if the at least one treatment unit and the two or more receiving units are movable and, in particular, displaceable relative to one another along at least one spatial direction. Alternatively or in addition, the at least one treatment unit and the two or more receiving units are, e.g., rotatable and/or pivotable relative to one another about at least one axis of rotation or pivot axis. The treatment result can be improved as a result of the relative movement.

The workpieces are favorably fixed to, e.g., pallet-shaped or plate-shaped support elements. Here, a fixation to the respective support element, in particular by force-locking and/or positive-locking connection, may be provided.

For example, the workpieces may be manually fixed to the support elements. It proves to be advantageous in practice if a, for example, pneumatically or electrically actuable actuator is provided. The actuator may be, e.g., a holding-down element.

The actuator can favorably be actuated during the treatment operation, for example during cleaning, deburring, or drying, such that the workpiece is released at least in sections. For example, the holding-down means is selectively opened and closed. By releasing the workpiece in the region of the actuator, a treatment of those regions of the workpiece that are otherwise acted upon by the actuator can be performed.

Provision is favorably made that the workpiece is held directly or indirectly, in particular by means of the support element, by force-locking and/or positive-locking connection to the at least one transport unit and/or the at least one receiving unit. The transport unit and/or the receiving unit is or comprises, for example, a pneumatically or electromotively actuated mechanism, for example in the form of a grabbing device.

The support element with the workpiece is favorably transferred by the transport unit directly to the receiving unit and vice versa.

Provision may be made that the mechanism of the transport unit and/or the receiving unit is monitored in order to determine whether the support element is held on the mechanism or released therefrom.

The pneumatic mechanism stated above and the pneumatic actuator are, for example, configured to hold the workpiece and the support element, respectively, by applying with negative pressure.

A preferred treatment system may comprise a plurality of treatment devices, each with at least one treatment unit, wherein the treatment units and the treatment operations performable therewith of different treatment devices differ from one another. The treatment system thereby has a high versatility. Different treatment operations can be performed on the workpiece with a view to an improved treatment result.

The treatment system may advantageously have a modular structure in which the treatment devices are combined or may be combinable depending on the treatment operation to be performed.

The treatment devices are advantageously positioned or positionable laterally next to one another, wherein the workpieces are preferably transportable by means of the transport device from one treatment device to an adjacent treatment device. This makes it possible to successively treat the workpieces according to the different treatment operations, wherein workpieces can be transported by means of the transport device from one treatment device to the next treatment device.

In particular, it is favorable if the treatment devices are arranged along a transport path of the transport device that is preferably extended rectilinearly, along which transport path the at least one transport unit is movable, wherein the workpieces are transportable along a transport direction defined by the transport path from one treatment device to a further treatment device.

The workpieces are favorably transportable by means of the transport device from one treatment device to the next treatment device while maintaining the arrangement, along the transport direction, of the receiving units thereof. For example, a working direction is always maintained by the treatment system. Here, provision is advantageously made in the case of the plurality of receiving units that the transport always takes place from the receiving unit of a treatment device positioned foremost along the transport direction to the foremost positioned receiving unit of the subsequent treatment device(s). The same applies to the receiving units of the treatment devices arranged at the respective second location in the treatment direction, etc.

It is advantageous if the treatment devices are positioned along the transport path in the order of treatment operations that are to be successively performed. In this way, a particularly efficient transport of the workpieces between the treatment devices can be performed.

The transport device may advantageously comprise two or more transport units, which are each moveable along a transport path. The control of the movement of the transport units can be effected by means of the control device.

The two or more transport units are advantageously displaceable along the transport path.

The transport device has, e.g., an electromagnetic linear drive for the at least one transport unit. Here, a rectilinearly extended stator is preferably present, which defines the transport direction from one treatment device to the next treatment device and thus the working direction.

In a preferred embodiment of the invention, the transport device may, for example, be of robotic configuration. For example, a robotic arm is provided as a transport device.

The receiving of the workpieces to be treated may be carried out, e.g., at an end side of the transport path that is favorably adjacent to the first used treatment device. The drop-off of treated workpieces may take place, e.g., at an end side of the transport path, which is adjacent to a treatment device with which the last treatment operation is performed. Provision may be made that the workpiece is removed from this end side or is transported by means of the at least one transport unit back to the first mentioned end side and is removed from there.

The side of the loading or receiving and the unloading side may be variable, with a view to adapting the processing of workpieces in dependence on different treatment operations.

It is favorable if workpieces are treatable by means of the treatment units of different treatment devices at the same time in order to be able to treat a highest possible number of workpieces with the treatment system.

The at least one treatment unit of the at least one treatment device may be configured in different ways, preferably for at least one of the following treatment operations:

- dry cleaning the workpiece;
- deburring the workpiece;
- cleaning and/or deburring the workpiece with pressurized and, in particular, high-pressure fluid;
- mechanically cleaning and/or mechanically deburring the workpiece;
- ultrasonic cleaning;
- cleaning the workpiece in an immersion bath;
- blowing off the workpiece;
- drying the workpiece, in particular vacuum drying the workpiece;
- coating and/or stripping the workpiece;
- roughening surfaces of the workpiece.

Provision may be made that the treatment unit is able to perform more than one of the aforementioned treatment operations.

After what has been said, it is understood that the at least one treatment unit, in particular, may be a cleaning unit and the at least one cleaning device, in particular, may be a cleaning device.

In particular, it can be made possible to deburr the workpiece by means of a high-pressure liquid jet (in particular water jet), which may be pulsing. High-pressure liquid jet deburring can be performed, e.g., using a switching apparatus, as it is described in the not previously published patent application DE 10 2019 108 512 or in EP 2 047 912 A1. Alternatively or in addition, a mechanical deburring can be performed by brushes or a different tool.

For drying the workpiece, for example, pressurized air and/or hot air can be used. Vacuum drying is also conceivable.

The at least one treatment unit can perform, e.g., a coating for surface finishing and/or conserving the workpiece.

For treating in a treatment operation, in particular for cleaning, for example, a dry fluid may be used, for example a gaseous medium, in particular air, compressed air, an inert gas, $CO_2$, or a different technical gas. The use of ionized air, laser radiation for ionization, or atmospheric plasma is conceivable. The ionization can be effected by means of discharge electrons. The temperature of the gaseous medium is, e.g., about 2° C. to about 150° C. The absolute humidity may be approximately up to 100%.

For example, water or demineralized water with or without additive(s), for example surfactants, may be used as wet fluid. The use of microbubbles in the liquid is conceivable, as well as the use of a cooling lubricant or oil.

The use of steam or dry steam at temperatures of about 100° C. to 250° C. may be provided.

In the case of wet cleaning, provision may be made that fluid is injected into a gas steam (for example air stream) and accelerated with the gas stream.

The use of a $CO_2$ jet (dry ice) is possible.

The use of hydrocarbons, of solvent-containing cleaning agents, acids, bases, as well as all mixtures of the aforesaid fluids is possible.

In the case of liquid fluids, the temperature may be, e.g., 2° C. to 99° C.

Auxiliary substances may be used as an additive for gaseous or liquid fluids, for example solid substances like granulates, salts, ice pellets, or $CO_2$ snow.

A treatment by irradiation may be provided. Here, different wavelengths even within the same treatment unit are conceivable, for example UV, microwaves, infrared, acoustic waves.

The at least one treatment unit may have, e.g., nozzles. The nozzles may be stationary or movable, for example rotatingly or in the manner of a spindle. For example, flat jet nozzles, round jet nozzles, fan-shaped nozzles, cyclone nozzles, or gap nozzles may be used as nozzle forms. The nozzles may be configured as multicomponent nozzles with a core jet and a surrounding jet jacket. The jet jacket may be formed by further nozzles at the periphery of the central nozzle or by a shield that sucks a medium from the surrounding area, for example by means of a Venturi effect. The nozzles may have, for example, a central pressure nozzle (also called rotary nozzle) and a surrounding suction nozzle (typhoon nozzle). Single- or multiple-nozzle systems may be provided.

As stated above, the treatment system may have a modular structure in the case of a plurality of treatment devices. The treatment operations explained above may, for example, be performed successively. For example, a dry cleaning, a deburring, wet cleaning, ultrasonic cleaning, underwater cleaning, spray cleaning, drying, coating, and cooling may be performed.

Overall, the modular structure of the system makes it possible to carry out different treatment operations in a variable manner, in dependence on the relative positioning of the treatment devices.

It is favorable if the treatment system comprises a detection unit coupled to the control device, with which a marking associated with a respective workpiece relating to at least one treatment operation to be performed is detectable, wherein the control device controls the at least one treatment device to treat the workpiece in dependence on the marking. For example, the marking is arranged on the workpiece or on a support element therefor, and takes the form of a machine-readable code. In dependence on the marking, the treatment device can adapt the treatment operation with a view to an optimal treatment result.

Alternatively or in addition, provision may be made that the treatment system comprises a storage unit coupled to the control device, in which treatment parameters are stored or storable that are associated with the workpieces, wherein the control device controls the at least one treatment device to treat the workpiece in dependence on the treatment parameters. In this way, for example, a workpiece-specific storage of treatment parameters is possible. The treatment parameters may be, e.g., pressures, volume flows, temperatures, cycle times, speeds, waiting times, process times etc.

The treatment system in accordance with the invention may be used with workpieces of different kinds, for example made of metal, ceramic, or plastics. The workpieces may be components from the field of general metalworking, engine parts, or transmission parts. For example, the workpieces are valves, brake master cylinders, hydraulic blocks, turbocharger housings, turbocharger impellers, camshaft adjusters, injection pumps, electric motor housings, cylinder heads, gearbox housings, wheels, or shafts. The workpieces may be components for electric motors, like, for example, spray bodies, housings, bearings, shafts. The workpieces may be generatively manufactured parts, for example by means of 3D printing. The workpieces may come from the field of medical technology and be implants, for example. The combination of different materials of the workpieces (hybrid workpieces) is conceivable.

The treatment system may be used in different industrial sectors, for example in the wood industry for the removal of machining residues like sawdust. Use in the metal industry for the removal of machining residues like cooling lubricants or machining oils is conceivable. Use in the plastics industry, electronics industry, or mechatronics industry is conceivable. In the field of generative manufacturing, for example in the case of 3D printing, the use of vibrations is conceivable in order to remove residual powder within cavities of the workpiece and on the surface thereof.

The treatment system is suitable, in particular, for surface treatment and specifically for cleaning and/or deburring, wherein preferably particulate and film-like contamination can be removed. Use for the removal of machining residues consisting of solids like shavings, blasting agents, casting core residues and tinsel burs is conceivable. Regarding film-like contamination, for example, cooling lubricants, oils, grease, release agents, abrasives or other kinds of production residues could be removed.

The present invention further relates to a method. The method in accordance with the invention for treating workpieces with at least one treatment device makes provision that a treatment device comprises at least one treatment unit which is configured to perform at least one treatment operation on the workpieces, in which method two or more workpieces are transferable by means of a respective receiving unit of the treatment device independently of one another from a transfer position into a treatment position and the at least one treatment unit is controlled such that the workpieces are treated in a time-offset manner according to a treatment operation of the same kind.

The advantages that have already been explained in the context of the treatment system in accordance with the invention can also be achieved using the method in accordance with the invention. Reference may be made to the preceding remarks in this regard.

Advantageous embodiments of the method result from advantageous embodiments of the treatment system in accordance with the invention. Reference may be made to the preceding remarks also in this regard.

FIG. 1 shows an advantageous embodiment of a treatment system in accordance with the invention, denoted as a whole with the reference numeral 10. The treatment system 10 serves to treat workpieces 12, of which a plurality of workpieces are depicted distinguishably from one another in FIGS. 2 to 18 and are further denoted with the reference numerals W1 to W11. Reference to the workpiece in general is denoted by the reference numeral 12.

For treating the workpieces 12, the treatment system 10 comprises a plurality of treatment devices for the surface treatment of the workpieces 12. The treatment devices are combined with one another in a modular manner to form the treatment system 10. Presently four treatment devices 14, 16, 18, and 20 are provided.

The treatment devices 14 to 20 are positioned laterally next to one another and are arranged along a transport device 22 for the transport of the workpieces 12. The transport device 22 comprises a rectilinearly extended transport path 24, which is configured as a displacement path. The extent of the transport path 24 defines a transport direction 26, said direction presently being a working direction of the treatment system 10.

The transport device 22 comprises for the transport of the workpieces 12 two transport units that are displaceable along the transport path 24, which transport units are labeled with "1" and "2" in the drawing.

The transport device 22 is presently of electromagnetic configuration, the transport path 24 forming a linear stator.

Figure 3:
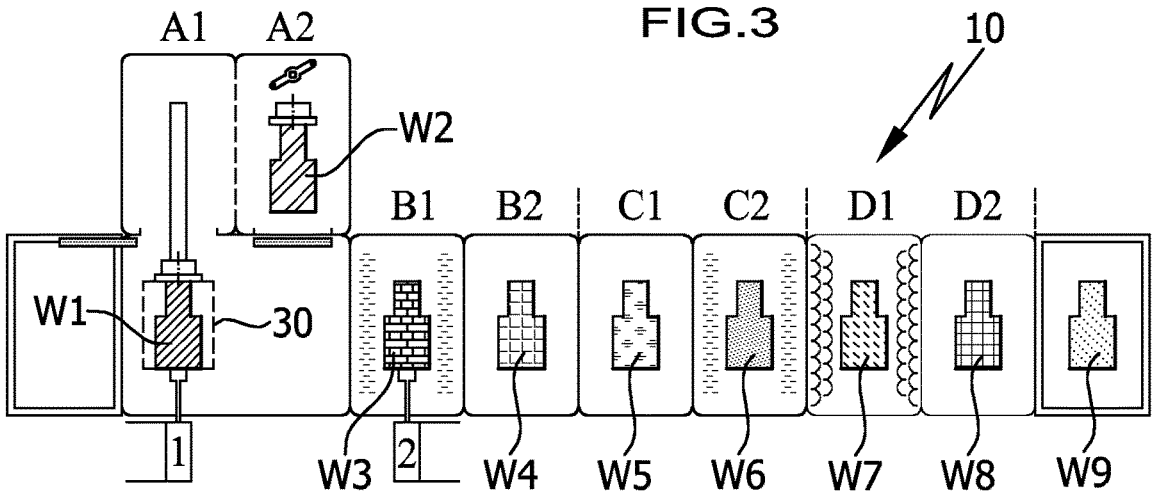

In the present case, the workpieces 12 are fixed to a support element 30 that is schematically depicted in FIG. 3. The support element 30 can be held by a respective transport unit 28 and thereby be transported on a respective treatment device 14 to 20 into a transfer position. The holding of the workpieces 12 on the support element 30, which is, e.g., of plate-shaped configuration, is effected, for example, by means of a holding-down element.

A control device 32 of the treatment system 10 is provided, which controls the transport device 22 and thus the transport of the workpieces 12. In addition, the control device 32 controls the treatment devices 14 to 20 and, therein, in particular the receiving units for the workpieces 12 and the treatment units mentioned below.

At an end side 34 that is adjacent to the treatment device 14, the transport device 22 has a placement surface 36 for workpieces 12. At an opposite end side 38 that is adjacent to the treatment device 20, the transport device 22 has a placement surface 40 for workpieces.

In relation to the transport direction 26, the treatment devices are arranged in the order 14-16-18-20.

As is made clear in the following explanations, the workpieces 12 are transported in the transport direction 26 and thereby subsequently treated by the treatment devices 14 to 20, wherein the transport takes place in each case by means of the transport units 28.

In the present case, the treatment device 14 is configured to deburr the workpieces 12 by means of a high-pressure fluid jet and, in particular, high-pressure water jet. To this end, the treatment device 14 comprise a treatment unit 42 with at least one high-pressure tool 44. In the present case, a switching apparatus 46 is provided, by means of which a desired high-pressure tool 44 can selectively be transferred into an operating position, as is described in the above-mentioned prior art.

The treatment device 14 is a deburring device, and the treatment unit 42 is a deburring unit.

It is understood that the treatment devices 14 to 20, in addition to the qualities of the treatment units as explained above, may comprise further assemblies for their function, as is known to the person skilled in the art. For example, a pump assembly is provided for the treatment unit 42 for provisioning a high-pressure cleaning liquid.

The treatment device 14 comprises a receiving space 48 with a first spatial region 50 and a second spatial region 52. The spatial regions 50, 52 are arranged laterally next to one another along the transport direction 26.

An adjusting unit 54 is associated with the treatment unit 42. By means of the adjusting unit 54, the switching apparatus 46 with the high pressure tool 44 can be moved, in particular, in parallel to the transport direction 26 from the spatial region 50 into the spatial region 52 and vice versa. In addition, provision may be made that a further movement in at least one further spatial direction and/or rotation and/or pivot is provided.

The treatment device 14 further has two receiving units 56, 58. The receiving units 56, 58 are arranged laterally next to one another along the transport direction 26 and are associated with a respective spatial region 50, 52 and positioned there.

The receiving units 56 and 58 can be moved by means of drive units 60 and 62, respectively. Here, in particular, a displacement transverse and, in particular, perpendicular to the transport direction 26 is possible. The displacement may take place in such a way that a workpiece 12 arranged at the transport position on the transport unit 28 can be collected by the respective receiving unit 56 or 58 and be transferred into the receiving space 48 in a treatment position.

The treatment device 14 comprises cover elements 64, 66, which are associated with the receiving units 56 and 58, respectively, and can selectively close openings 68 and 70, respectively. In particular, provision is made that a respective cover element 64 closes an opening 68 when the workpiece 12 is treated at the associated receiving unit 56 by means of the treatment unit 42. The respective cover element 64, 66 can unblock the opening 68 or 70 when the workpiece 12 is transferred by means of the respective receiving unit 56 or 58 from the transfer position into the treatment position or vice versa, i.e., in particular for exchanging the workpiece 12.

Drive units 72, 74 are associated with the cover elements 64, 66, respectively.

During the treatment operation, the workpieces 12 on the receiving units 56, 58 are moved relative to the treatment unit 42 by means of the drive units 60 and 62, respectively, for example translationally and/or rotationally, with a view to a best possible deburring result.

In the case of the treatment device 14, there is the advantage, in particular, that the treatment unit 42 can deburr a workpiece 12 of one receiving unit 56 or 58 while the workpiece 12 of the respective other receiving unit 56, 58 is being exchanged. Between the spatial regions 50, 52, the treatment unit 42 can be brought to the respective workpiece 12.

The treatment device 16 comprises two treatment units 76, 78 arranged next to one another along the transport direction 26. The treatment units 76, 78 are of identical configuration and each comprise an immersion basin 80, 82, in which a fluid jet cleaning of the workpieces 12 can be performed. The treatment device 16 is a deburring device, and the treatment units 76, 78 are cleaning units.

Cleaning tools 84 and 86 can be moved relative to the workpiece 12 by means of drive units 88 and 90, respectively, while said workpieces are, for example, arranged stationarily in the immersion basin 80, 82.

For transferring the workpieces 12 from the transport units 28, the treatment device 16 comprises receiving units 92, 94 with drive units 96 and 98, respectively, associated therewith, which are each merely schematically depicted in FIG. 1.

The treatment units 76, 78 can be controlled independently of one another by the control device 32. Here, it is possible, in particular, to clean the workpiece 12 at a treatment unit 76 or 78 while a workpiece 12 is exchanged at the other treatment unit 78 and is transferred from the transfer position into the treatment position or vice versa.

The treatment device 18 is presently configured with treatment units 100, 102 that are arranged laterally next to one another along the transport direction 26 and are presently of identical configuration. The treatment units 100, 102 are configured to blow off and predry the workpieces 12. For this purpose, receiving spaces 104 and 106 are provided, which are formed similarly to the immersion basins 80, 82, respectively, cleaning tools 108 and 110, respectively, with drive units 112 and 114, respectively, as well as receiving units 116, 118 with drive units 120 and 122, respectively.

The treatment device 18 is a cleaning device, and the treatment units 100, 102 are cleaning units.

The treatment units 100, 102 can be controlled independently of one another by the control device 32. Here, it is possible, in particular, that the workpieces 12 are cleaned with a treatment unit 100, 102 while the workpiece 12 is exchanged by means of the receiving unit 104, 106 of the other treatment unit 100, 102 and is transferred from the transfer position into the treatment position or vice versa.

The treatment device 20 comprises two treatment units 124, 126 that are arranged laterally next to one another along the transport direction 26 and are presently of identical configuration. The treatment units 124, 126 are presently configured to vacuum dry the workpieces 12. Similar to the treatment device 18, the treatment device 20 comprises receiving spaces 128 and 130 of the treatment units 124 and 126, respectively, cleaning tools 132 and 134, respectively, receiving units 136 and 138, respectively, and drive units 140 and 142, respectively.

The treatment device 20 is a cleaning device, and the treatment units 124, 126 are cleaning units.

The treatment units 124, 126 are controllable independently of one another by the control device 32. In the case of the treatment device 20, provision may be made, in particular, that a workpiece 12 at one treatment unit 124, 126 is dried while a workpiece 12 at the other treatment unit 124, 126 is exchanged by means of the corresponding receiving unit 136, 138 and is transferred from the transfer position into the treatment position or vice versa. This operation is schematically depicted in FIG. 1.

In the drawing, "A1, A2" denote the treatment stations at the spatial regions 50, 52 in which the treatment unit 42 can alternatingly be positioned. The labels "B1, B2" denote the treatment station at the treatment units 76, 78, the labels "C1, C2" denote the treatment stations at the treatment units 100, 102, and the labels "D1, D2" denote the treatment stations at the treatment units 124, 126.

The treatment system 10 may comprise a detection unit 144 (FIG. 1) that is coupled to the control device 32. For example, the detection unit 144 is of optical configuration in order to detect markings, for example codes, arranged on the workpieces 12 or the support elements 30. A respective treatment operation that is carried out by the treatment devices 14 to 20 can be adapted to the workpiece 12 in dependence on the markings.

Parameters for performing the treatment operations may be stored, e.g., in a storage unit 146, in particular in a workpiece specific manner, wherein the storage unit 146 is presently integrated into the control device 32.

An exemplary functioning of the treatment system 10, using the method in accordance with the invention, is explained in the following using the example of FIGS. 2 to 18.

Figure 2:
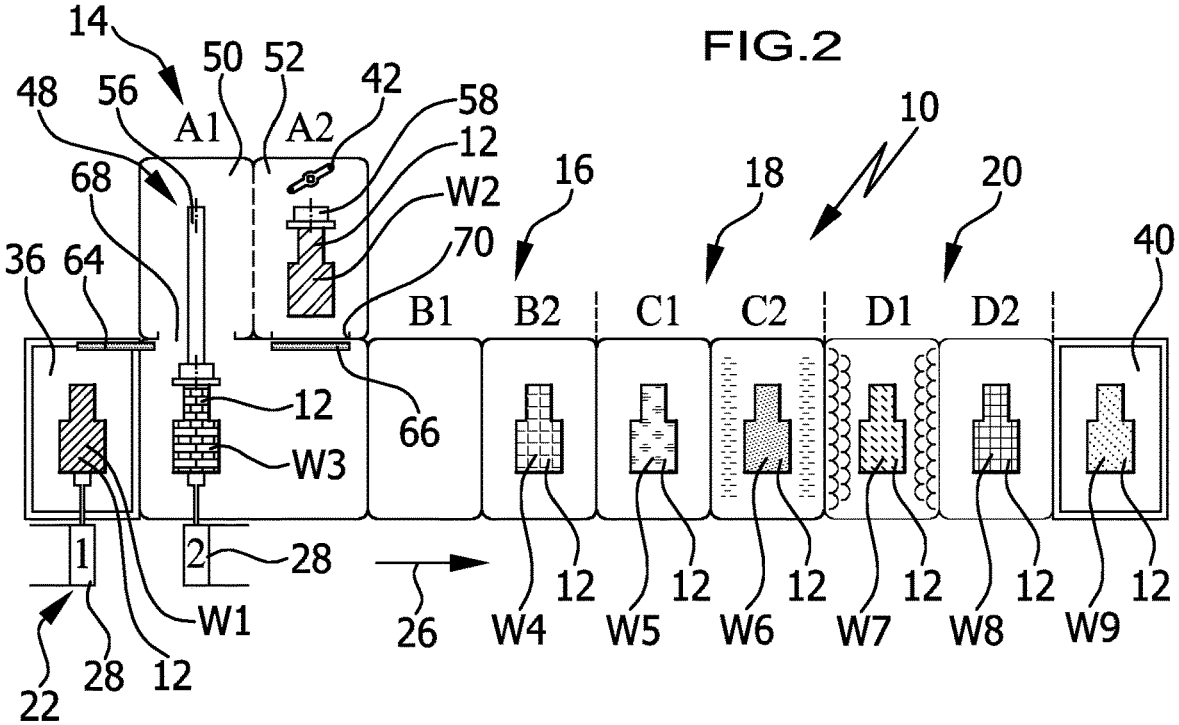
FIGS. 2 to 18: show the treatment system from FIG. 1 during the treatment of workpieces at different times in a schematic representation.

Here, in particular, the treatment device 14 is explained first. FIGS. 2 and 3 depict the treatment of the workpiece W2, the treatment unit 42 being arranged in the spatial region 52. The workpiece W2 is exchanged by means of the transport unit 28 and is brought to the station B1 with the treatment unit 76. The workpiece W1 is transported by means of the further transport unit 28 and is transferred with the receiving unit 56 from the transfer position into the treatment position.

Figure 7:
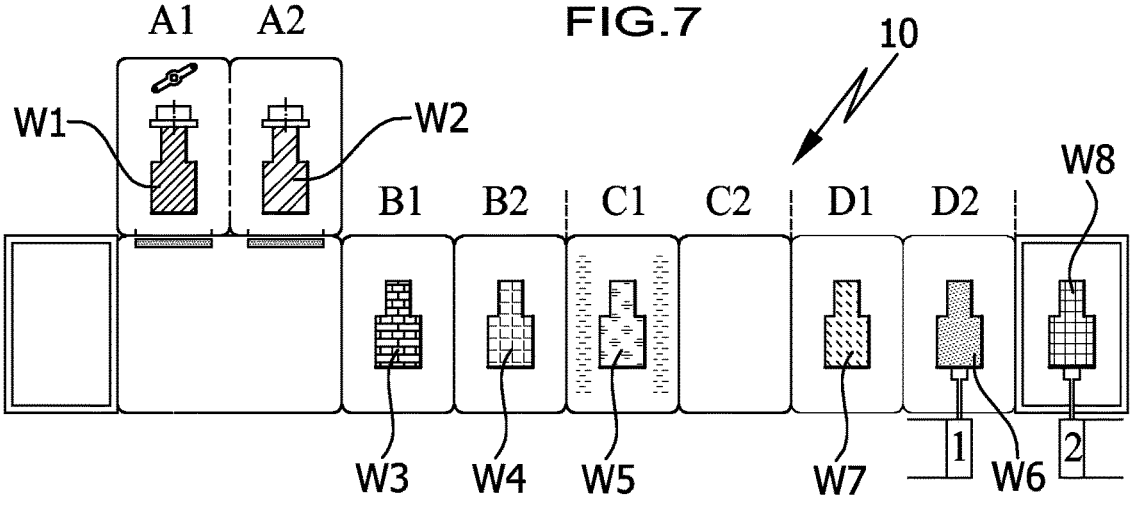
Figure 8:
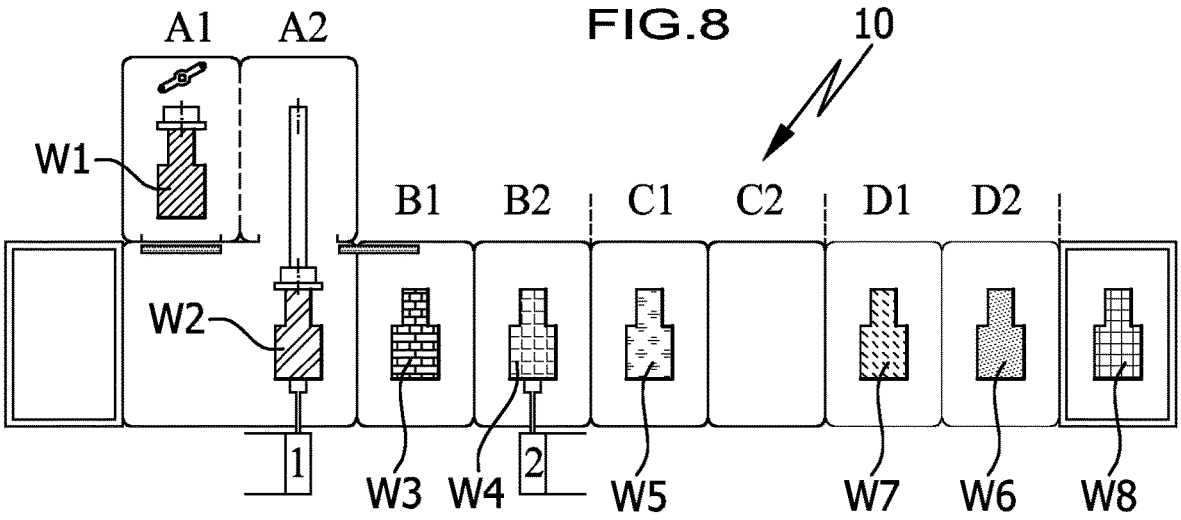

In the following (FIGS. 4 to 11), the workpiece W1 is deburred by means of the treatment unit 42 that has now been moved into the spatial region 50. The workpiece W2 remains in the spatial region 52 (FIGS. 4 to 7) until it can be fed by means of the transport unit 28 to the freed station B2 with the treatment unit 78 (FIGS. 8 and 9).

Figure 9:
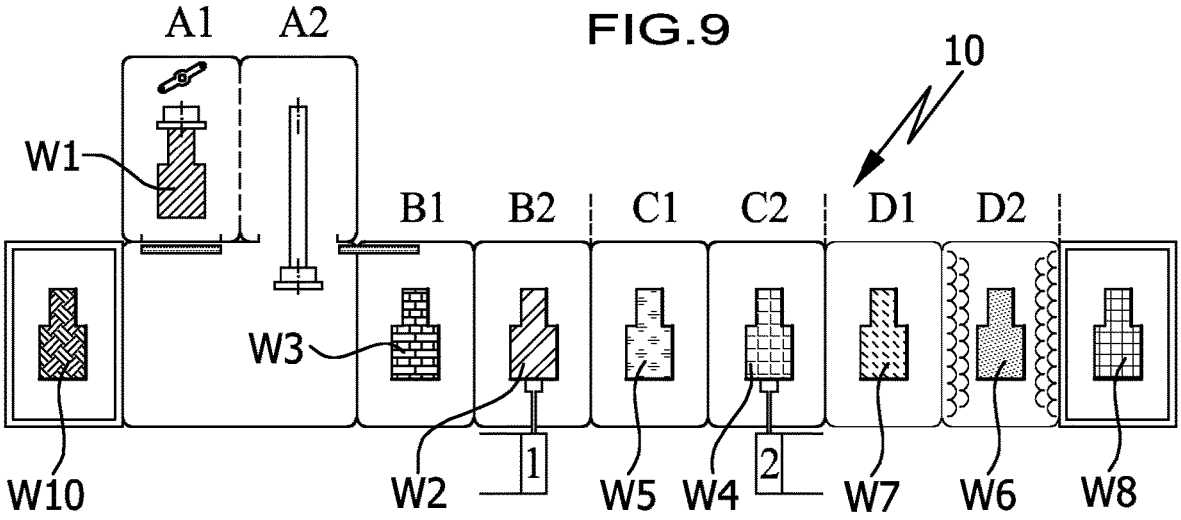
Figure 10:
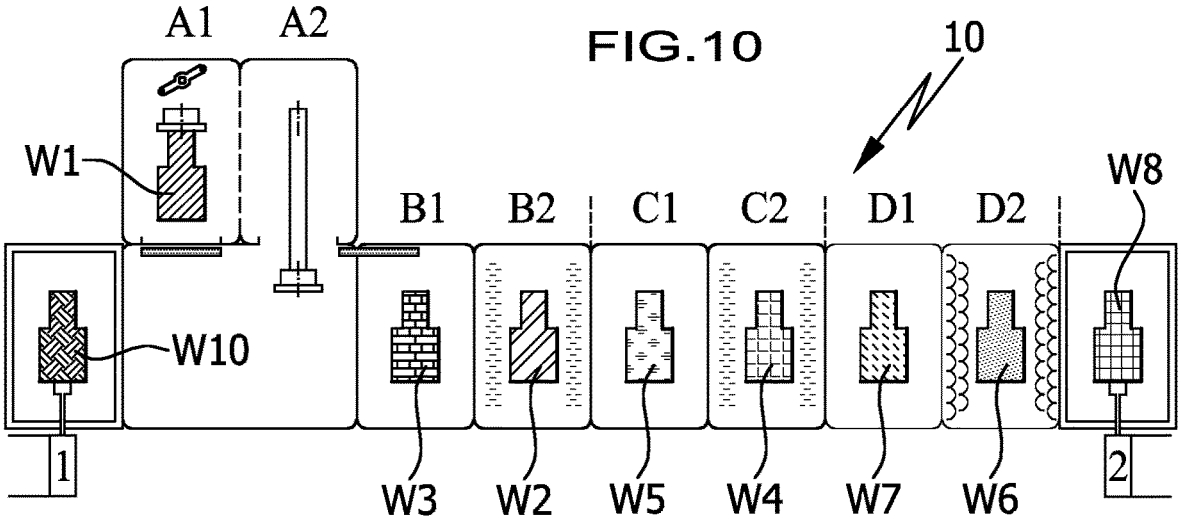
Figure 11:
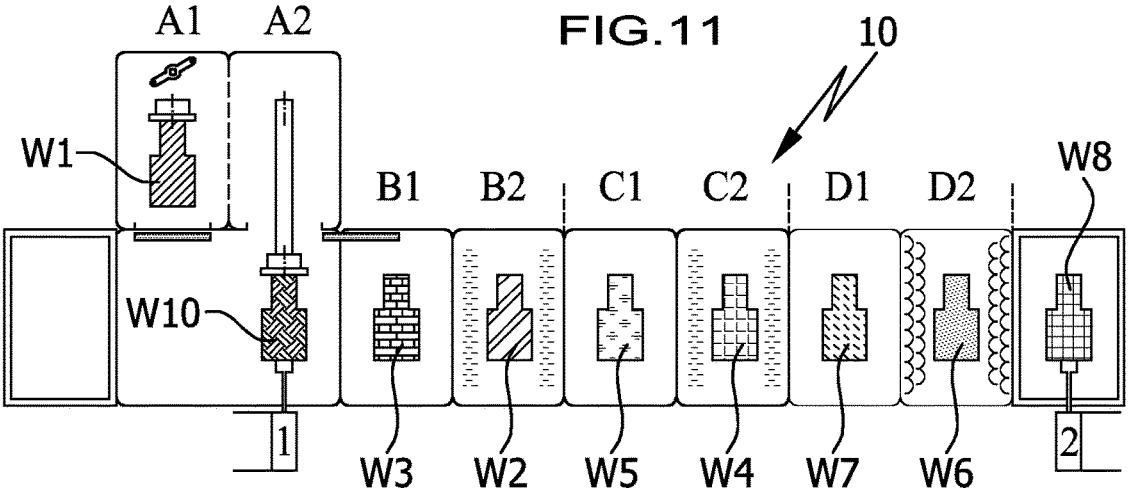

Subsequently, the workpiece W10 is transported with the transport unit 28 to the station A2, wherein it is transferred with the receiving unit 58 into the treatment position (FIGS. 9 to 11).

Figure 16:
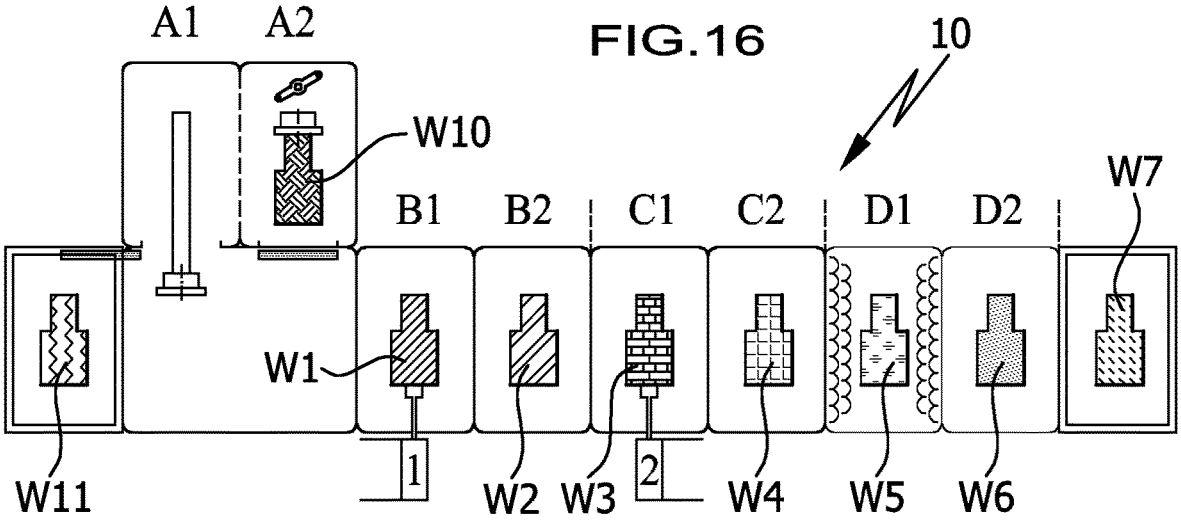
Figure 17:
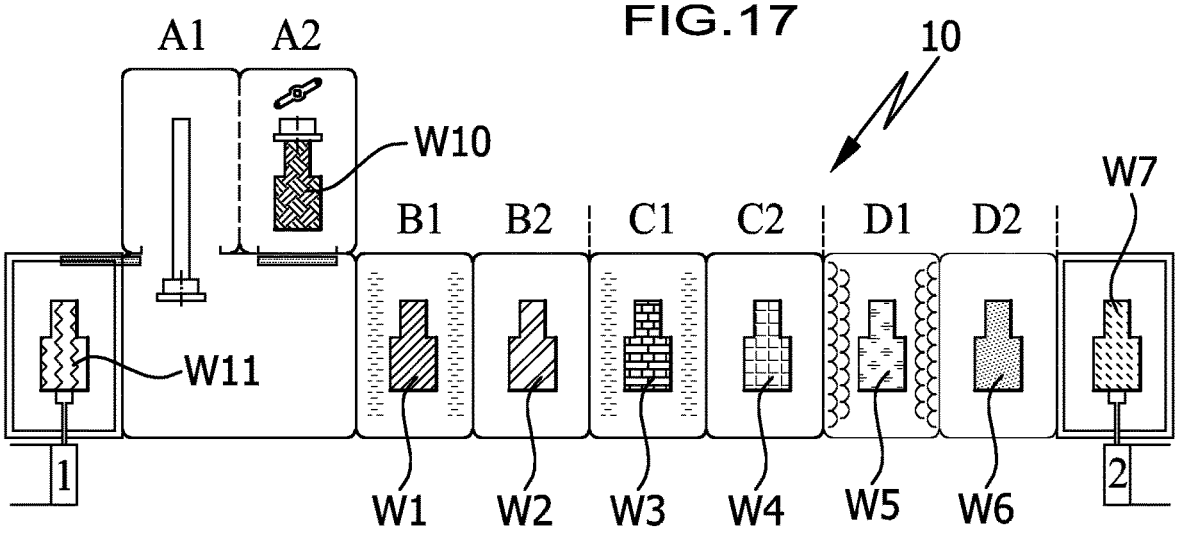
Figure 18:
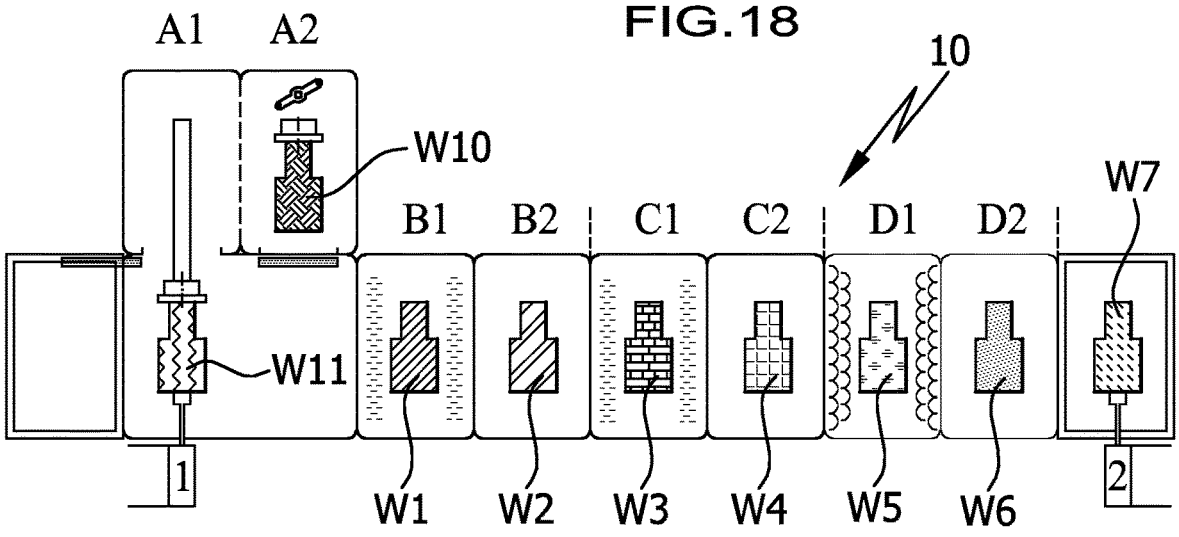

Then, the deburring of the workpiece W10 takes place in the spatial region 52 (FIGS. 12 to 18). The workpiece W1 remains at the station A1 in the spatial region 50 (FIGS. 12 to 14) until it can be transferred with the receiving unit 56 into the transfer position (FIG. 15) and be fed by means of the transport unit 28 to the freed station B1 with the treatment unit 76 (FIG. 16). Subsequently, a further workpiece is then fed to the station A1 with the workpiece W11 (FIGS. 17 and 18).

The foregoing statements show that during the treatment of a workpiece 12 in one of the stations A1 or A2, it is possible, in particular, to exchange the workpiece 12 out of the respective other station A2 or A1 and to load said station with a new workpiece 12 to be treated or to transport the workpiece 12 to one of the following stations B1 or B2.

The same applies to the treatment devices 16, 18, and 20, and the stations B1, B2, C1, C2, D1 and D2.

Figure 4:
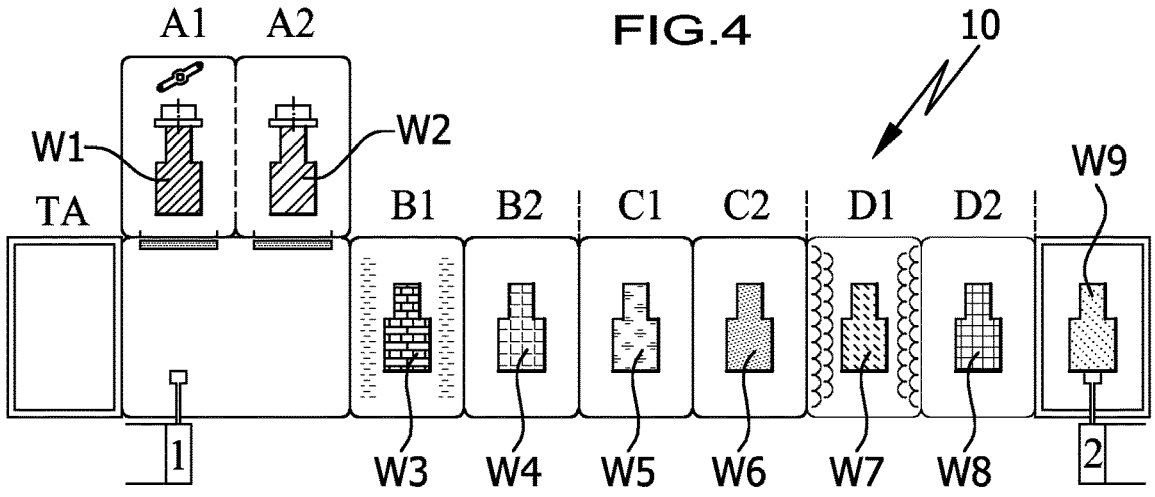
Figure 5:
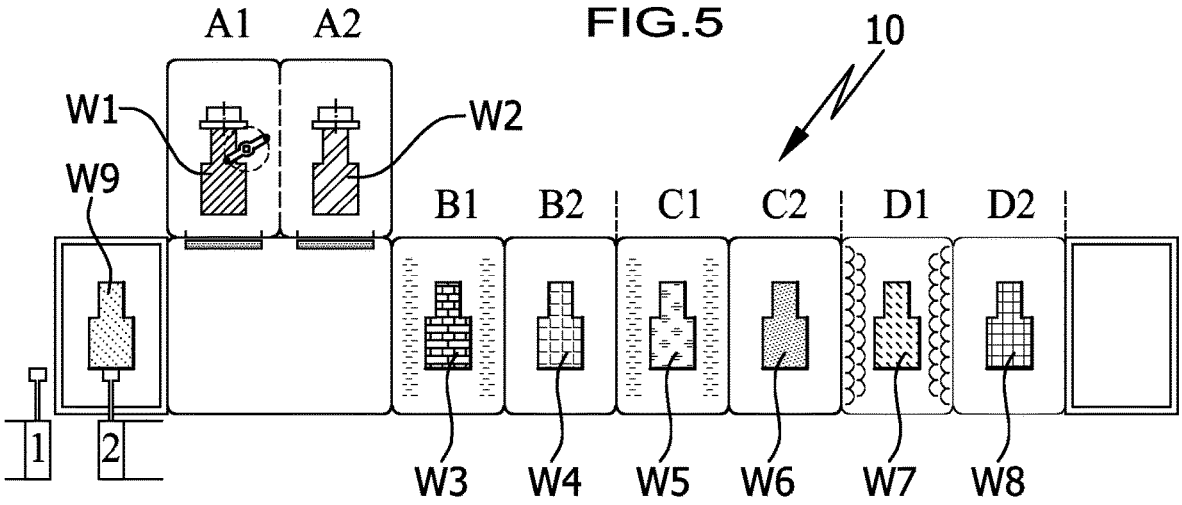

For example, FIGS. 3 to 5 show by means of hatching the cleaning of the workpiece W3 in the station B1 with the treatment unit 76, whereas the workpiece W4 in station B2 with the treatment unit 78 waits for further transport to the treatment device 18 and, in particular, to the station C2 thereof with the treatment unit 102. This exchange of the workpiece W4 takes place in the step according to FIG. 8, and the station B2 is loaded with the workpiece W2 that in the meantime has been deburred (FIG. 9).

Figure 12:
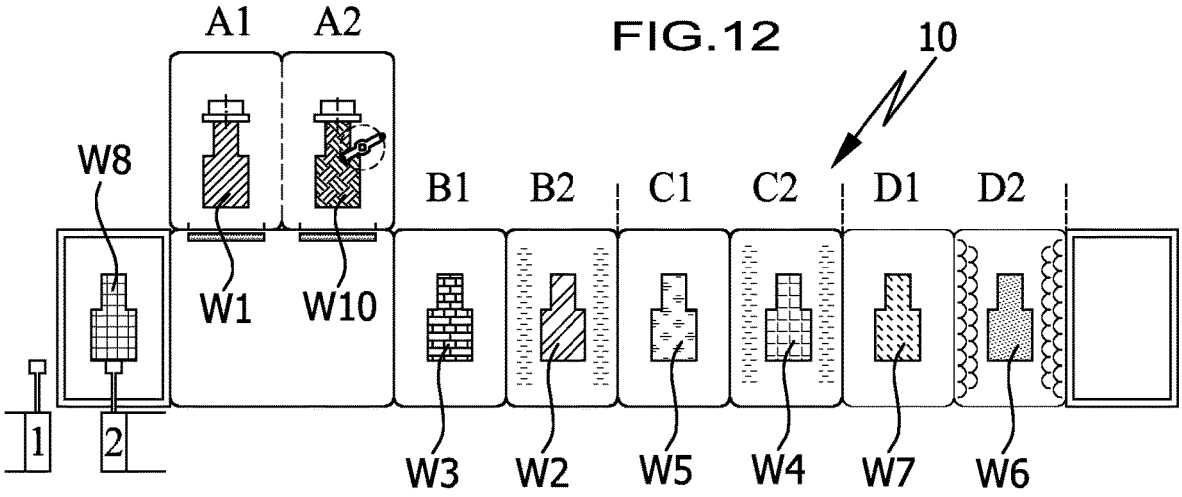

While the workpiece W3 waits for the exchange following the cleaning in FIGS. 6 to 15 and is finally transferred into the freed station C1 with the treatment unit 100, the fed workpiece W2 in FIGS. 10 to 12 is cleaned off with the treatment unit 78. The workpiece W2 in FIGS. 13 to 18 then waits for the exchange and for the station C2 to become free for further cleaning.

Figure 6:
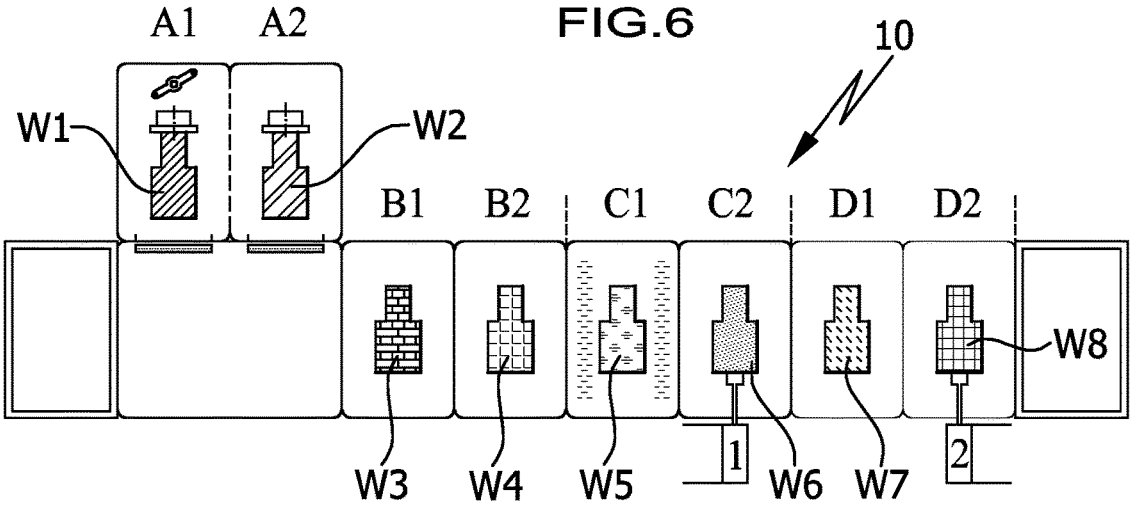
Figure 13:
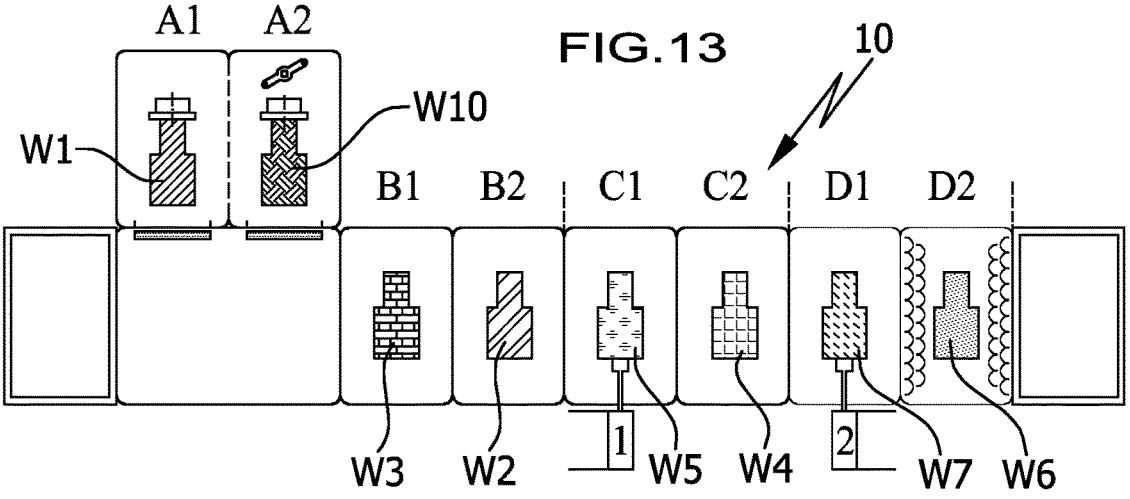
Figure 14:
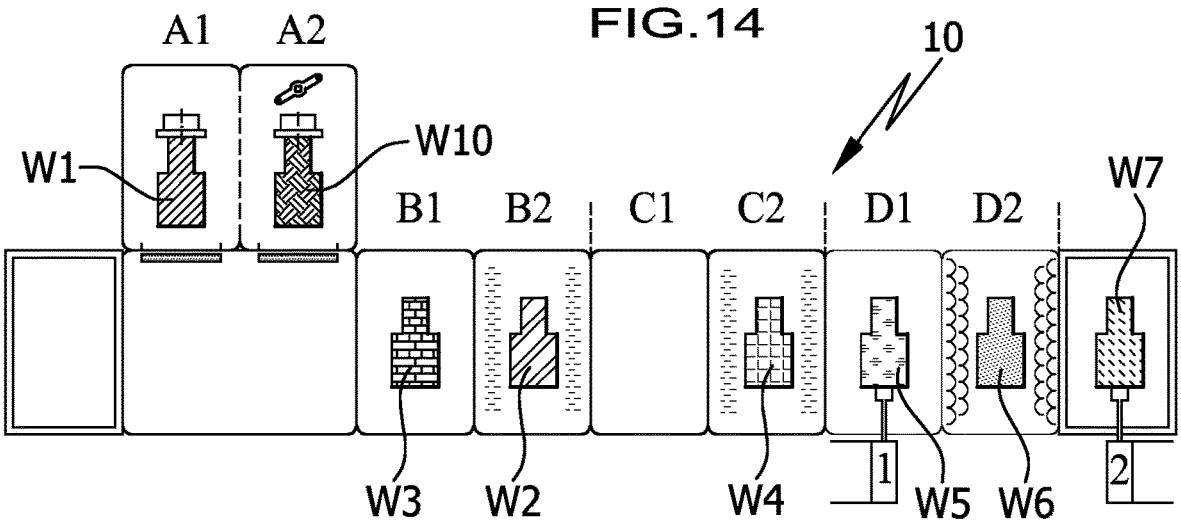
Figure 15:
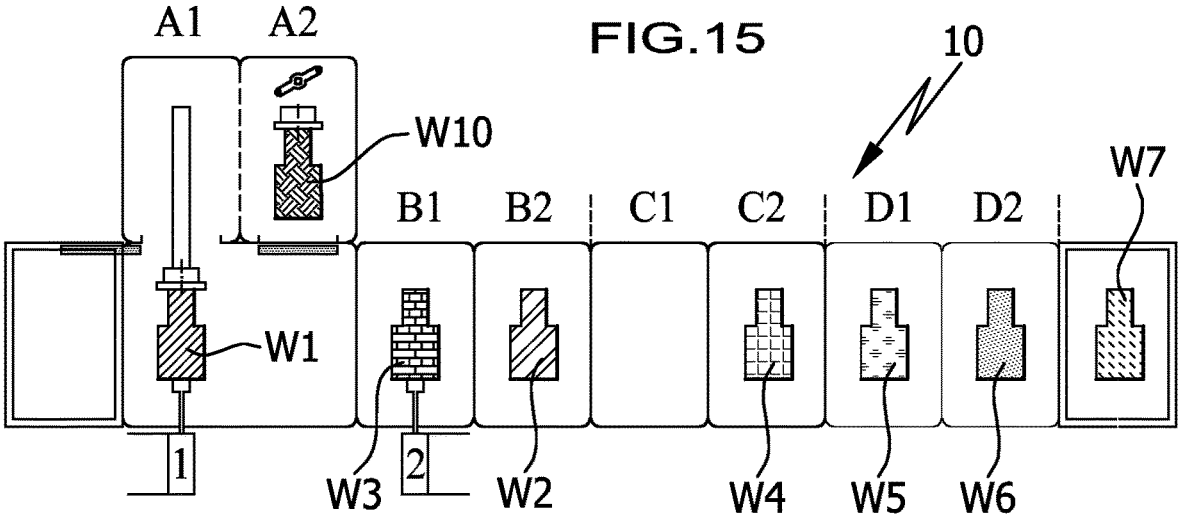

In the station C2 with the treatment unit 102, first the workpiece W6 is cleaned (FIGS. 2 and 3), which then (FIGS. 6 and 7) is transferred for drying into the now freed station D2 with the treatment unit 126. The station C1 with the treatment unit 100 receives the workpiece W5, which is cleaned after the cleaning of the workpiece W6 (FIGS. 5 to 7). Subsequently, the workpiece W5 waits (FIGS. 8 to 12) until the station D1 with the treatment unit 124 has become free, and is transported to there (FIGS. 13 and 14).

Then, the workpiece W5 in station D1 is dried, as can be seen based on the schematically depicted steam (FIGS. 16 to 18), after the workpiece W6 had previously been dried in the station D2 (FIGS. 9 to 14). This drying operation in the cleaning apparatus 20 is preceded in turn by the drying operation for the workpiece W7 in the station D1 with the treatment unit 124 (FIGS. 2 to 5).

Workpieces W1 to W11, which have passed through the stations D1 or D2 with the drying operation by means of the treatment units 124, 126, are then transported to the placement surface 40 by means of the transport units 28. FIGS. 2 to 4 show this using the example of the workpiece W9, FIGS. 8 to 11 using the example of the workpiece W8, and FIGS. 14 to 18 using the example of the workpiece W7.

Cleaned workpieces are then transported from the placement surface 40 back to the placement surface 36 by means of the transport unit 28 (recognizable by the workpiece W9 in FIG. 5 and the workpiece W8 in FIG. 12).

By means of the treatment system in accordance with the invention and the performable method, an efficient treatment of workpieces can be carried out while reducing dead times and while utilizing the exchange times. The modular configuration of the treatment system 10 is advantageous, in which, further, a workpiece-specific cleaning is possible, for example by means of the cleaning parameters in the storage unit 124 or using the detection unit 144.

REFERENCE NUMERAL LIST

10 treatment system
12 workpiece
14, 16, 18, 20 treatment device
22 transport device
24 transport path
26 transport direction
28 transport unit
30 support element
32 control device
34 end side
36 placement surface
38 end side
40 placement surface
42 treatment unit
44 high-pressure tool
46 switching apparatus
48 receiving space
50, 52 spatial region
54 adjusting unit
56, 58 receiving unit
60, 62 drive unit
64, 66 cover element
68, 70 opening
72, 74 drive unit
76, 78 treatment unit
80, 82 immersion basin
84, 86 cleaning tool
88, 90 drive unit
92, 94 receiving unit
96, 98 drive unit
100, 102 treatment unit
104, 106 receiving space
108, 110 cleaning tool
112, 114 drive unit
116, 118 receiving unit
120, 122 drive unit
124, 126 treatment unit
128, 130 receiving space
132, 134 cleaning tool
136, 138 receiving unit
140, 142 drive unit
144 detection unit
146 storage unit

The invention claimed is:

1. Treatment system for surface-treating workpieces comprising at least one treatment device that has at least one treatment unit, which is configured to perform at least one treatment operation on a workpiece to be treated, as well as at least one receiving unit for accommodating the workpiece to be treated on or in the treatment device, a transport device that comprises at least one transport unit, with which the workpiece to be treated is transferable into a transfer position from which the workpiece to be treated is transferable by means of the at least one receiving unit into a treatment position, a control device for controlling the at least one treatment unit, the at least one receiving unit, and the at least one transport unit, wherein the at least one treatment device comprises two or more receiving units for accommodating a respective workpiece for transferring independently of one another into the treatment position, wherein the control device controls the at least one treatment unit such that the workpieces are treated by said treatment unit in a time-offset manner according to a treatment operation of the same kind and wherein the treatment device comprises or forms a receiving space and an adjusting unit for the at least one treatment unit, which is movable by means of the adjusting unit from a first spatial region in which a receiving unit is arranged into at least one further spatial region in which a further receiving unit is arranged, for treating a respective workpiece on the at least one receiving unit according to the treatment operation.

2. Treatment system in accordance with claim 1, wherein two or more workpieces are provided and a first workpiece is treatable by means of the at least one treatment unit, while a second workpiece is transferable by means of the at least one receiving unit associated therewith from the treatment position into the transfer position or vice versa.

3. Treatment system in accordance with claim 1, wherein the workpiece to be treated is treatable at a particular time by means of the at least one treatment unit.

4. Treatment system in accordance with claim 1, wherein the treatment device comprises two or more functionally equivalent or identically configured treatment units, wherein a treatment unit is associated with a respective receiving unit.

5. Treatment system in accordance with claim 1, wherein the at least one treatment unit is displaceable by means of the adjusting unit in the receiving space along a direction that is aligned in parallel to a transport path of the transport device, along which the at least one transport unit is movable or displaceable.

6. Treatment system in accordance with claim 1, wherein the at least one receiving unit includes multiple receiving units, and wherein the multiple receiving units are positioned laterally next to one another along a transport direction.

7. Treatment system in accordance with claim 1, wherein the at least one receiving unit includes two or more receiving units, wherein the at least one treatment device comprises a receiving space for accommodating the two or more receiving units, in which the at least one treatment unit is arranged, as well as two or more cover elements that are associated with a respective receiving unit of the two or more receiving units, wherein a respective cover element unblocks an opening of the receiving space when the respective receiving unit transfers the workpiece from the transfer position into the treatment position, and closes the respective opening when the workpiece to be treated is treated in the treatment position by means of the at least one treatment unit.

8. Treatment system in accordance with claim 1, wherein the at least one receiving unit includes multiple receiving units, and wherein the multiple receiving units are movable transversely or perpendicularly to a transport direction for transferring the workpiece to be treated from the transfer position into the treatment position, along which transport direction the at least one transport unit is movable or displaceable, along a transport path of the transport device.

9. Treatment system in accordance with claim 1, wherein the at least one treatment unit and the at least one receiving unit are at least one of movable or displaceable relative to one another along at least one spatial direction and/or rotatable and/or pivotable relative to one another about at least one axis of rotation or pivot axis.

10. Treatment system in accordance with claim 1, wherein the treatment system comprises a plurality of treatment devices, each with at least one treatment unit, wherein the treatment units and the treatment operations performable therewith of different treatment devices differ from one another.

11. Treatment system in accordance with claim 10, wherein a modular structure is provided, wherein the treatment devices are combined or combinable depending on the treatment operations to be performed.

12. Treatment system in accordance with claim 10, wherein the treatment devices are positioned or positionable laterally next to one another, wherein the workpieces are transportable by means of the transport device from one treatment device to an adjacent treatment device.

13. Treatment system in accordance with claim 12, wherein the treatment devices are arranged along a transport path of the transport device, along which transport path the at least one transport unit is movable, wherein the workpieces are transportable along a transport direction defined by the transport path from one treatment device to a further treatment device.

14. Treatment system in accordance claim 10, wherein the workpieces are transportable by means of the transport device from one treatment device to the next treatment device while maintaining the arrangement, along the transport direction, of the receiving units thereof.

15. Treatment system in accordance with claim 1, wherein the transport device comprises two or more transport units, which are each movable or displaceable along a transport path.

16. Treatment system in accordance with claim 1, wherein at least one treatment unit of the at least one treatment device is configured for at least one of the following treatment operations:

- dry cleaning the workpiece to be treated;
- deburring the workpiece to be treated;
- at least one of cleaning and deburring the workpiece to be treated with pressurized fluid or with high pressure fluid;
- at least one of mechanically cleaning and mechanically deburring the workpiece to be treated;
- ultrasonic cleaning;
- cleaning the workpiece to be treated in an immersion bath;
- blowing off the workpiece to be treated;
- drying the workpiece to be treated;
- vacuum drying the workpiece to be treated;
- at least one of coating and stripping the workpiece to be treated;
- roughening surfaces of the workpiece to be treated.

17. Treatment system in accordance with claim 1, wherein the treatment system comprises a storage unit coupled to the control device, in which treatment parameters are stored or storable that are associated with the workpieces, wherein the control device controls the at least one treatment device to treat the workpiece to be treated in dependence on the treatment parameters.

* * * * *